US005504328A

United States Patent [19]

Bonser

[11] Patent Number: 5,504,328

[45] Date of Patent: Apr. 2, 1996

[54] ENDPOINT DETECTION UTILIZING ULTRAVIOLET MASS SPECTROMETRY

[75] Inventor: Douglas J. Bonser, Austin, Tex.

[73] Assignee: Sematech, Inc., Austin, Tex.

[21] Appl. No.: 352,579

[22] Filed: Dec. 9, 1994

[51] Int. Cl.[6] ..... H01J 49/00

[52] U.S. Cl. ..... 250/288; 250/281; 250/282

[58] Field of Search ..... 250/288, 281, 250/282, 423 P; 156/626.1

[56] References Cited

U.S. PATENT DOCUMENTS

| | | | |
|---|---|---|---|
| 4,105,921 | 8/1978 | Bartlett et al. | 250/288 |
| 4,140,905 | 2/1979 | Polanyi | 250/423 P |
| 4,158,775 | 6/1979 | Chutjian et al. | 250/281 |
| 4,164,592 | 11/1979 | Kitamori et al. | 250/288 |
| 4,383,171 | 5/1983 | Sinha et al. | 250/288 |
| 4,584,072 | 4/1986 | Arisawa et al. | 250/423 P |
| 5,144,127 | 9/1992 | Williams et al. | 250/281 |
| 5,316,970 | 5/1994 | Batchelder et al. | 250/423 P |
| 5,338,931 | 8/1994 | Spangler et al. | 250/423 P |

OTHER PUBLICATIONS

Tilford, "Process monitoring with residual gas analyzers (RGAs): limiting factors," *Surface and Coatings Technology*, 68/69 pp. 708–712 (1994).

*Primary Examiner*—Jack I. Berman
*Assistant Examiner*—Kiet T. Nguyen
*Attorney, Agent, or Firm*—Arnold, White & Durkee

[57] ABSTRACT

An apparatus and method for detecting the endpoint of an etch during semiconductor fabrication is provided. The endpoint detection system utilizes a mass spectrometer having an energy source located outside the vacuum chamber of the endpoint detection system, thus providing an easily replaceable energy source. The energy source may be a light source to provide photo-ionization. The energy source may be selected based upon the gas species of the etch of which an endpoint as being detected. The energy is directed into an ionization chamber of the endpoint detection system through a transparent window.

21 Claims, 1 Drawing Sheet

ENDPOINT DETECTION UTILIZING ULTRAVIOLET MASS SPECTROMETRY

BACKGROUND OF THE INVENTION

The present invention relates to mass spectrometers, and more particularly, to utilizing mass spectrometers for endpoint detection during the etching steps of semiconductor fabrication.

During the fabrication of semiconductor devices, many layers of the device are etched utilizing plasma etching techniques. Often, the various steps within a plasma etch are ended by detecting a change within the plasma or a change in the gas phase species produced by the reaction of the plasma with the wafer being etched. Such an approach for ending a step within a plasma etch is known as endpoint detection. One common technique for detecting an endpoint for a plasma etch is to monitor the optical emissions of the plasma. However, such system do not adequately sense endpoints in all environments, especially in downstream etching techniques. Downstream etching is a method in which the substrate to be etched is not directly within the RF plasma, but rather, downstream of the plasma. Optical emission endpoint detection systems generally do not provide an adequate sensitivity for use with downstream etching in a production environment.

An alternative approach for endpoint detection is to utilize a mass spectrometer. In particular, a quadrupole mass spectrometer may be utilized. In such an approach, the mass spectrometer may be mounted to the etch apparatus to provide access to either the plasma process chamber or the downstream exhaust from the plasma process chamber. FIG. 1 shows a side view of a schematic of a typical electron impact ionization mass spectrometer apparatus 100 as may be utilized for endpoint detection. The mass spectrometer apparatus 100 may include a flange 105 for connecting the apparatus 100 to the process chamber or process exhaust line of the etch apparatus. The mass spectrometer hardware is located within the apparatus 100. The mass spectrometer hardware includes a filament 115, a focusing lens 125, an ionizer grid 120, a mass filter 130, and a detector 135. The filament 115 ionizes molecules. Electrons are accelerated from the filament 115 to the impact ionizer grid 120 by a voltage which is applied between the filament and the grid. A focusing lens 125 focuses ions into the quadrupole mass filter 130. The focusing lens 125 may include multiple lenses. The quadrupole mass filter 130 has a RF signal applied to four rods to select a desired mass to charge ratio of ions that pass through the filter 130 to be detected on a detector 135. The detector 135 may be either an electron multiplier or a Faraday cup. The mass spectrometer hardware may be mounted within a housing 101 on an end mounting plate 140. Because the filament 115 must be operated at low pressures, typically $10^{-4}$ Torr or less, a differential pump 150 is required to lower the pressure within the ionization chamber 155 formed by the housing 101. The mass spectrometer hardware described above is well known and is commercially available from several sources including the Micromass model from VG, the Dataquad model from Spectramass, and the model 100C from UTI.

Utilizing a standard mass spectrometer system as described above presents several problems. First, the life time of filament 115 is short and unpredictable. Thus, the filament would have to be changed often for use in a production endpoint detection system. Moreover, changing the filament would require accessing the chamber formed by housing 101. Therefore, the maintenance downtime to replace the filament is greatly increased due to standard venting, cleaning and pump down techniques. Thus, it would be desirable to provide an endpoint detection system which minimizes the problems discussed above.

SUMMARY OF THE INVENTION

An endpoint detection system is provided in which a mass spectrometer is utilized to detect a change in a plasma etch. The endpoint detection system utilizes an energy source that is located outside of the ionization chamber of the mass spectrometer ionization chamber. Thus, the energy source may be easily changed without having to access the ionization chamber. The energy source utilized may be electromagnetic energy such as a light source. In one embodiment, an ultraviolet light source is utilized to provide ionization via photo-ionization mechanisms. The energy may be directed into the ionization chamber of the endpoint detection system through a transparent window.

The endpoint detection system of the present invention may be mounted to an etch apparatus in a variety of manners. For example, the endpoint detection system may be mounted to the process chamber of an etch apparatus or alternatively may be mounted to a line downstream of the process chamber.

DETAILED DESCRIPTION

Figure 1:
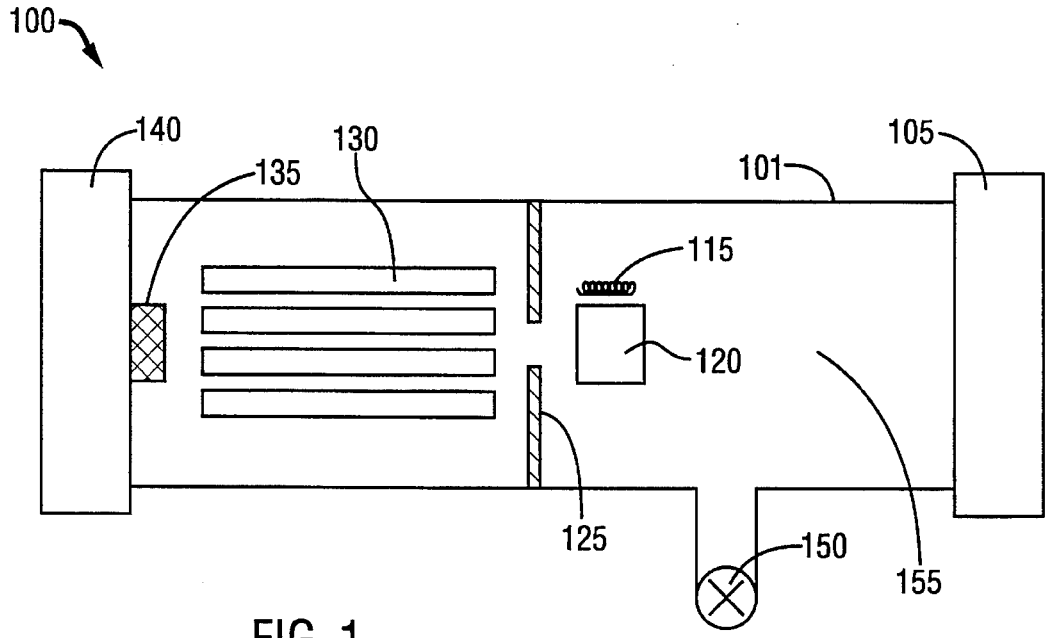
FIG. 1 (Prior Art)
FIG. 1 illustrates a prior art endpoint detection system utilizing a mass spectrometer.
Figure 2:
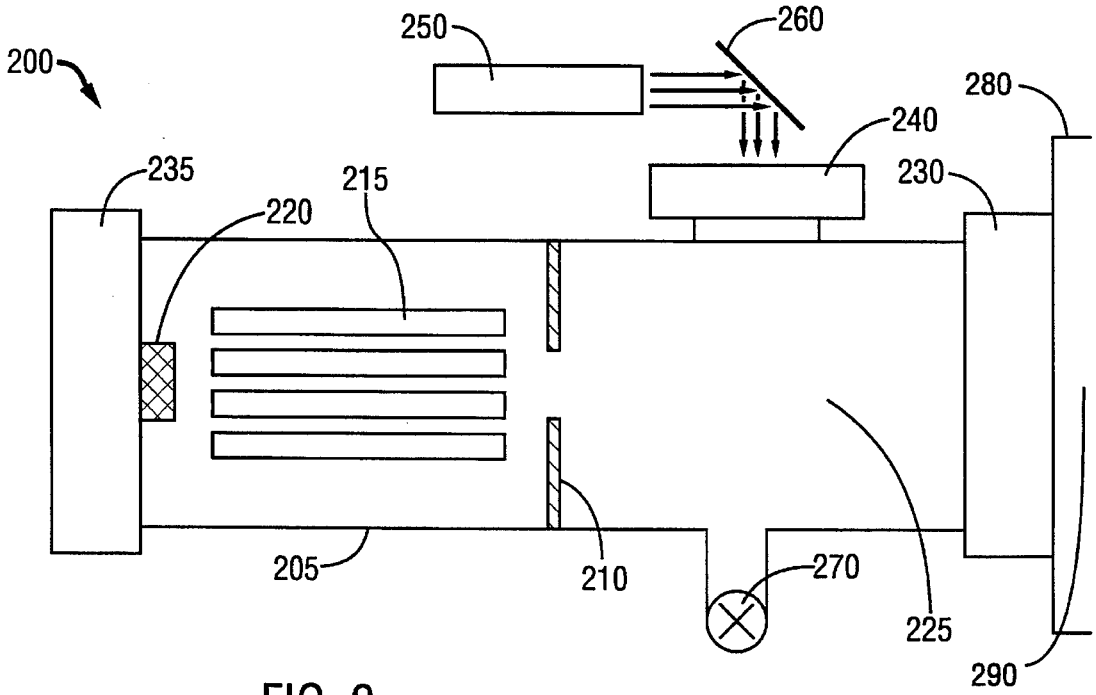
FIG. 2 illustrates an endpoint detection system according to the present invention.

An endpoint detection system 200, according to the present invention, is shown in FIG. 2. The endpoint detection system 200 includes a housing 205 within which a focusing lens 210, a quadrupole mass filter 215 and an ion detector 220 are located. The focusing lens 210, the quadrupole mass filter 215 and the detector 220 may be standard apparatus used in mass spectrometers such as lens 125, filter 130 and detector 135 described above with reference to FIG. 1. The present invention is not limited to quadrupole mass filters, and thus, mass filter 215 may be another type of filter such as, for example, a time of flight driftable filter. Housing 205 includes an ionization chamber 225 in which ionization occurs. Housing 205 also includes a mounting flange 230 and an endplate 235. Mounting flange 230 may be mounted on either the process chamber of a plasma etch apparatus or the downstream exhaust pump line of a plasma etch apparatus. It may be bolted or attached using standard attachment methods to access a port in process chamber or pump line. The flange allow the gas species used during the plasma etch to enter the ionization chamber 225. The flange 230 may be any one of a variety of flanges or ports such as, for example, a 2.75 inch conflat flange, a mini-conflat flange, or a quick flange o-ring type connection. Alternatively, other mounting mechanisms which provide an airtight seal through which gas in the etch apparatus may flow into the endpoint detection system may be utilized.

According to the present invention, ionization occurs within chamber 225. Energy enters the ionization chamber 225 via a transparent window 240. An energy source 250 directs energy through the transparent window 240 into the ionization chamber 225 so as to ionize the gas phase species within the chamber 225. The window 240 need only be sufficiently transparent to allow the desired energy to pass into the chamber 225. Because the energy source 250 is located outside of chamber 225, chamber 225 does not have to be vented to atmosphere to change the light source. A variety of ionization techniques are known in the art and the present invention is not limited to any one technique.

In one embodiment of the present invention, the energy source 250 may be an electromagnetic energy source. The specific wavelength and bandwidth of the electromagnetic energy source desired may be dependent upon the process conditions (such as the process gas and pressures) utilized in the etch apparatus. In one embodiment, the electromagnetic energy source may be a light source such as a UV light source. When utilizing a light source such as a UV light source, the ionization mechanism will be photo-ionization.

Alternatively, the energy source 250 may be a laser, microwave irradiation, or other emf sources. As shown in FIG. 2, optics 260 or a waveguide may be used to focus energy from the energy source 250 towards the transparent window 240. Alternatively, the energy source 250 may be directly aimed at the transparent window 240.

After the ionization occurs within ionization chamber 225, conventional mass spectrometry techniques may be used to focus the ions through the lens 210 into the quadrupole mass filter 215 and to the detector 220. The detector 220 may be a Faraday cup or an electron multiplier such as a channeltron. The choice of detector 220 will depend upon the strength of the signal obtained from the ionization. In any case, standard electron multipliers or Faraday cups may be used as is known in the spectrometry art. As a change occurs in the process or reaction product gasses of the etch apparatus, the signal generated by detector 220 will also change. Thus an endpoint may be detected by monitoring changes of the detector signal.

Also dependent upon the ionization mechanism selected (i.e., the energy wavelength, bandwidth and gas species) is the pressure that must be maintained within the ionization chamber 225. Generally as pressure is increased, the number of molecules present to be ionized increases and thus a higher signal may be obtained. However, competing factors may cause the signal to decrease with increased pressures. For example, the mean free path of ions decreases with increasing pressure. Thus, at higher pressures collisions between molecules and ions or ions and ions are more likely to occur prior to detection. This can cause neutralization and loss of signal. Thus, a pump 270 as shown in FIG. 2 may be required to lower the pressure within the ionization chamber 225. A mechanical pump and orifice may be all that is necessary to provide sufficiently low pressures. Alternatively, a pump 270 may not be required since the pressure at which the process chamber of the etch apparatus is maintained may be sufficiently low to allow adequate detection. In such a case, the pressure within the ionization chamber 225 may be maintained sufficiently low by the pressure level maintained within the etch apparatus.

The present invention provides several benefits and solutions to the problems discussed above. First, a variety of types of energy sources may be utilized including light sources such as ultraviolet sources that are very robust and long lasting compared to the filaments of the prior art. Moreover, because the light source may be mounted external to the vacuum chamber within the detection system, the light sources may be replaced easily without having to access chamber 225. Thus, a more production worthy endpoint detection system is provided. Alternatively, the use of a long lasting energy source such as a UV light may allow a production worthy system even if the UV light source is placed within the ionization chamber. Thus, benefits of the present invention may be obtained by utilizing photo-ionization to ionize the gas species irrespective of whether the light source is located within or outside the ionization chamber.

Further modifications and alternative embodiments of this invention will be apparent to those skilled in the art in view of this description. For example, the energy sources and ionization mechanism shown herein are generally examples which may be chosen, however, it will be recognized that the present invention may be utilized with other energy sources or ionization mechanisms. Furthermore, the present invention is not limited to any specific etch chemistry. Accordingly, this description is to be construed as illustrative only and is for the purpose of teaching those skilled in the art a manner of carrying out the invention. It will be understood that the forms of the invention herein shown and described are to be taken as illustrative embodiments. Equivalent elements or materials may be substituted for those illustrated as described herein, and certain features of the invention may be utilized independently of the use of other features, all as would be apparent as one skilled in the art after having the benefit of this description of the invention.

What is claimed is:

1. An endpoint detection system for detecting an endpoint condition in a semiconductor etch apparatus comprising:

a housing, said housing attachable to said etch apparatus to allow a process gas from said etch apparatus to enter said housing;

an ionization chamber within said housing;

a mass spectrometer filter within said housing;

an ion detector for receiving ions that pass through said filter; and an ionization energy source located outside said ionization chamber for ionizing said process gas in said ionization chamber so that said ionization energy source accessed without affecting a subatmospheric pressure within said ionization chamber and said etch apparatus.

2. The endpoint detection system of claim 1 wherein said ionization energy source is an electromagnetic energy source.

3. The endpoint detection system of claim 2 wherein said electromagnetic energy source is a light source, said light source causing photo-ionization of said process gas in said ionization chamber.

4. The endpoint detection system of claim 3, wherein said housing further comprises:

a mounting mechanism located at one end of said housing for attaching said housing to a process chamber of said etch apparatus.

5. The endpoint detection system of claim 3, wherein said housing further comprises:

a mounting mechanism located at one end of said housing for attaching said housing to a line downstream of a process chamber of said etch apparatus.

6. The endpoint detection system of claim 1, further comprising:

a window attached to said housing between said ionization chamber and said ionization energy source for transmitting energy into said ionization chamber.

7. The endpoint detection system of claim 6 wherein said ionization energy source is a light source.

8. The endpoint detection system of claim 7, further comprising:

focussing optics located between said light source and said window.

9. The endpoint detection system of claim 8, wherein said housing includes a flange for attaching said housing to said etch apparatus.

10. The endpoint detection system of claim 7 wherein said mass spectrometer filter is a quadrupole mass filter and said ion detector is a Faraday cup, said endpoint detection system further comprising:

a focusing lens within said housing and located between said ionization chamber and said mass spectrometer filter.

11. An endpoint detection system for detecting an endpoint condition in a semiconductor etch apparatus comprising:

a housing, said housing attachable to said etch apparatus to allow a process gas from said etch apparatus to enter said housing;

an ionization chamber within said housing;

a mass spectrometer filter within said housing;

an ion detector for receiving ions that pass through said filter; and a light energy source for providing energy to photo-ionize said process gas in said ionization chamber said light energy source being located outside of said ionization chamber, so that said energy source is accessed without affecting a subatmosphere pressure within said ionization chamber and said etch apparatus.

12. The endpoint detection system of claim 11, further comprising:

a window between said ionization chamber and said energy source for transmitting energy into said ionization chamber.

13. The endpoint detection system of claim 12 wherein said mass spectrometer filter is a quadrupole mass filter.

14. A method for detecting an endpoint in an etching apparatus comprising the steps of:

allowing a process gas of said etching apparatus to enter an ionization chamber of an endpoint detection system;

transmitting energy into said ionization chamber from an ionization energy source outside of said ionization chamber to ionize said process gas said energy source being accessible without affecting a subatmospheric pressure within said ionization chamber and said etching apparatus;

filtering ions from said ionization chamber according to a mass of said ions; and detecting said filtered ions.

15. The method of claim 14, further comprising the step of:

photo-ionizing said process gas in said ionization chamber.

16. The method of claim 14, further comprising the step of:

passing said energy through a window before said energy enters said chamber.

17. The method of claim 14, further comprising the step of:

focusing said ions with a lens, wherein said step of filtering is performed with a quadruple mass filter and said step of detecting is performed with a Faraday cup.

18. The method of claim 14, wherein said ionization energy source is an electromagnetic energy source.

19. The method of claim 18, wherein said ionization energy source is a light source, said method further comprising the step of:

passing said energy through a window before said energy enters said chamber.

20. The method of claim 18, wherein said allowing step further comprises the step of:

obtaining said process gas from a process chamber of said etching apparatus.

21. The method of claim 18, wherein said allowing step further comprises the step of:

obtaining said process gas from a line downstream of a process chamber of said etching apparatus.

* * * * *

UNITED STATES PATENT AND TRADEMARK OFFICE

CERTIFICATE OF CORRECTION

PATENT NO. : 5,504,328

DATED : April 2, 1996

INVENTOR(S) : Douglas J. Bonser

It is certified that error appears in the above-identified patent and that said Letters Patent is hereby corrected as shown below:

In claim 1, column 4, line 40, after "source" insert --is--.

In claim 20, column 6, line 34, delete "comprises" and insert --comprising--.

In claim 21, column 6, line 39, delete "comprises" and insert --comprising--.

Signed and Sealed this

Tenth Day of September, 1996

*Attest:*

Bruce Lehman

BRUCE LEHMAN

*Attesting Officer*

*Commissioner of Patents and Trademarks*